US010214990B2

(12) United States Patent
Girardi et al.

(10) Patent No.: US 10,214,990 B2
(45) Date of Patent: Feb. 26, 2019

(54) SAFETY DEVICE FOR A FLUID PRODUCTION WELL, ASSOCIATED INSTALLATION AND METHOD

(71) Applicant: GEOSERVICES EQUIPEMENTS, Roissy-en-France (FR)

(72) Inventors: Francois Joseph Girardi, Roissy-en-France (FR); François Chevillard, Roissy-en-France (FR)

(73) Assignee: GEOSERVICES EQUIPEMENTS, ROISSY EN FRANCE (FR)

( * ) Notice: Subject to any disclaimer, the term of this patent is extended or adjusted under 35 U.S.C. 154(b) by 260 days.

(21) Appl. No.: 15/100,139

(22) PCT Filed: Dec. 2, 2014

(86) PCT No.: PCT/US2014/068024
§ 371 (c)(1),
(2) Date: May 27, 2016

(87) PCT Pub. No.: WO2015/084773
PCT Pub. Date: Jun. 11, 2015

(65) Prior Publication Data

US 2017/0022785 A1 Jan. 26, 2017

(30) Foreign Application Priority Data

Dec. 2, 2013 (EP) ..... 13306647

(51) Int. Cl.
*E21B 34/06* (2006.01)
*E21B 23/02* (2006.01)
(Continued)

(52) U.S. Cl.
CPC ..... *E21B 34/06* (2013.01); *E21B 23/02* (2013.01); *E21B 34/16* (2013.01);
(Continued)

(58) Field of Classification Search
CPC ..... E21B 2034/002; E21B 2034/005; E21B 2034/007; E21B 34/06–34/34; F16K 31/12; F16K 31/122; F16K 31/1221
See application file for complete search history.

(56) References Cited

U.S. PATENT DOCUMENTS 3,874,634 A 4/1975 Gazda
6,269,874 B1 8/2001 Rawson et al.
(Continued)

FOREIGN PATENT DOCUMENTS

FR 2890099 B1 3/2007
WO 2003048517 A1 6/2003

OTHER PUBLICATIONS

International Search Report and Written opinion dated Mar. 12, 2015 in the related International application PCT/US2014/068024, 13 pages.

(Continued)

*Primary Examiner* — Blake E Michener
(74) *Attorney, Agent, or Firm* — Michael Dae

(57) ABSTRACT

Safety device (10) for a fluid production well, comprising a valve (58) used to seal a passage, and which can move between an open position of the passage (52) and a closed position of the passage (52); and connecting biasing means (92) for permanently biasing the valve (58) towards the closed position thereof. The device comprises holding means (42) for holding the valve (58) in its open position against permanent biasing means (92), and actuating means (42, 44) which are configured to actuate the holding means (42), on reception of a maintenance signal, to generate: *a first displacement of the movement element (98) from the active valve biasing position to an intermediate valve biasing position, in which the valve (58) remains in its open position; and *a subsequent second return displacement of (Continued)

the movement element (58) from the intermediate valve biasing position to the active valve biasing position.

17 Claims, 7 Drawing Sheets

(51) Int. Cl.
*E21B 34/16* (2006.01)
*E21B 41/00* (2006.01)
*E21B 47/06* (2012.01)
*E21B 34/00* (2006.01)

(52) U.S. Cl.
CPC ..... *E21B 41/0021* (2013.01); *E21B 47/06* (2013.01); *E21B 2034/005* (2013.01)

(56) References Cited

U.S. PATENT DOCUMENTS 6,513,594 B1 2/2003 McCalvin et al.
7,231,971 B2 6/2007 McCalvin
8,220,534 B2 * 7/2012 Millet ..... E21B 23/02 166/322
2002/0108747 A1 * 8/2002 Dietz ..... E21B 34/066 166/66.7
2011/0186303 A1 * 8/2011 Scott ..... E21B 34/066 166/373
2012/0234558 A1 * 9/2012 Godfrey ..... E21B 34/10 166/374

OTHER PUBLICATIONS

International preliminary report on patentability issued in the related PCT Application PCT/US2014/068024, dated Jun. 7, 2016 (8 pages).
Extended European Search Report issued in the related EP Application 13306647.2, dated May 13, 2014 (6 pages).
Office Action issued in the related EP Application 13306647.2, dated Apr. 19, 2016 (4 pages).

* cited by examiner 10
40
78
74
76
58
90
92
64
88
108
73
122
110
100
69
98
112
69A
75A
101
62
75
75C
42
75B
60
104
50
114
102
52
94
107
70
66
106
72
68
120
107B

SAFETY DEVICE FOR A FLUID PRODUCTION WELL, ASSOCIATED INSTALLATION AND METHOD

The present invention relates to a safety device for a fluid production well, comprising:

a valve housing intended to be fixed tightly inside a fluid flow conduit, the housing delimiting a fluid flow passage and comprising:

a valve used to seal the passage, and which can move between an open position of the passage and a closed position of the passage;

connecting biasing means for permanently biasing the valve towards the closed position thereof; and connecting means for connecting the housing to a coupling member for a working wire line intended to move and anchor the housing in the conduit;

holding means for holding the valve in its open position against the permanent biasing means, said holding means comprising at least one movement element for the valve, which can move in the valve housing between a rest position and an active valve biasing position of the valve, and an element for permanently returning the movement element to its rest position; and actuating means which can be controlled by a control signal to actuate the holding means upon receipt of a valve open control signal by the actuating means, and to deactivate the holding means in the absence of said control signal.

Such a device is used to secure a well for the production of oil or another fluid (notably gas, vapour or water), in particular when said well is eruptive and can be sealed rapidly in case of failure of the surface installation, said failure producing the disconnection of the open control signal.

A device of the above-mentioned type is known from U.S. Pat. No. 8,220,534. Said device is lowered in a production casing of an oil well by means of a working wire line. It comprises a valve housing, a flow tube for holding the valve in the open position and an hydraulic unit for actuating the support flow tube. The hydraulic unit is fixed to the housing and can be lowered by the same wire line as the valve housing.

When a control signal is received by the hydraulic unit, the valve is held in the open position by the flow tube, against a return spring.

In the absence of a control signal, the return spring is deployed to move the flow tube, which allows rapid sealing of the valve.

Such devices have numerous advantages. They are autonomous and can be installed and anchored at any point of the well, whatever the finished architecture thereof. Also, they can be fully controlled from the surface.

These devices consume little energy. They can therefore operate over a long period of time, for example between six months and two years, without the need to raise the device to the surface.

For most of the time spent into the well, the valve flapper is maintained in an open position by the flow tube actuated by the hydraulic unit under pressure. After some time in the hostile environment of a well, there is however a risk that the sealing O-rings used in the valve deteriorate and block the flow tube and/or the flapper in place.

In order to ensure the valve properly closes when an emergency is declared, it is hence a standard procedure to close the valve at regular intervals.

Such a procedure guarantees the safe operation of the valve, but has the major drawback of stopping the production of the well, which is detrimental and costly for the operator of the well.

One aim of the invention is therefore to provide a safety device comprising a reliable safety valve, which can be operated for an extended time in a well, without affecting the production of the well.

Accordingly, the invention relates to a device of the above-mentioned type, characterized in that the actuating means are configured to actuate the holding means, on reception of a maintenance signal, to generate:

a first displacement of the movement element from the active valve biasing position to an intermediate valve biasing position, in which the valve remains in its open position; and a subsequent second return displacement of the movement element from the intermediate valve biasing position to the active valve biasing position.

The device according to the invention may comprise one or more of the following features, taken in isolation or in any technically feasible combination:

the actuating means comprising a hydraulic cylinder and a hydraulic unit for controlling the cylinder;

the hydraulic unit projects at least in part in relation to the housing, outside the flow passage, the flow passage being clear between the connection means and the valve;

the hydraulic unit can be removed from the valve housing, said valve housing comprising means for receiving the unit;

the actuating means comprise a hydraulic cylinder and a hydraulic control unit for the cylinder the cylinder comprising:

a control fluid pressurising chamber, said chamber receiving a portion of the movement element of the valve; and a control fluid reserve and discharge fluid reservoir, and in the hydraulic control unit comprises:

a pump for feeding the control fluid into the pressurising chamber;

a pressurising conduit connecting the pressurising chamber to the discharge fluid reservoir; and a first discharge conduit fastened on the pressurising conduit provided with a main discharge valve that is open in the absence of the control signal, and closed in the presence of the control signal;

the hydraulic control unit comprises a secondary discharge conduit, fastened on the pressurising conduit, the secondary discharge conduit being provided with a secondary discharge valve that is configured to open for a given period of time, after reception of the maintenance signal, in order to generate said first displacement, the secondary discharge valve being configured to close again after the given period of time;

the secondary discharge conduit is provided with a restriction orifice placed in series with the secondary discharge valve;

the hydraulic control unit comprises a secondary discharge conduit fastened on the pressurising conduit, the secondary discharge conduit being provided with a restriction, the restriction having a section lower than the section of the first discharge conduit, the secondary discharge conduit being permanently open through the restriction;

the actuating means comprise a rapid discharge conduit, fastened on the pressurising conduit, the rapid discharge conduit being provided with a sealing element that can be released when the main discharge valve is open;

the maximum cross-section of the first discharge conduit and of the upstream portion of the pressurising conduit situated upstream of the releasable sealing element is less than the minimum cross-section of the rapid discharge conduit and of the downstream portion of the pressurising conduit situated downstream of the releasable sealing element;

the secondary discharge conduit opens in the pressurizing conduit between the pressurizing chamber and the first discharge conduit;

the actuating means comprise a pressurisation piston of the fluid reservoir and a biasing element of the pressurisation piston, distinct from the element for permanently returning the movement element its rest position;

it comprises an element for guiding the movement element, advantageously fixed relative to the housing, the biasing element being inserted between a surface of the guiding element and the pressurization piston, the element for permanently returning the movement element to its rest position being inserted between an opposite surface of the guiding element and the movement element;

in the active valve biasing position, an end part of the movement element protrudes beyond the valve in the open position, the end part of the movement element also protruding on the valve in the open position in the intermediate valve biasing position;

the maximum cross-section of the first discharge conduit and of the upstream portion of the pressurising conduit situated upstream of the releasable sealing element is less than the minimum cross-section of the rapid discharge conduit and of the downstream portion of the pressurising conduit situated downstream of the releasable sealing element;

the actuating means comprise a control fluid accumulator connected to the pressurising chamber;

the actuating means comprise a zero-leakage non-return valve, interposed between the pump and the pressurising chamber;

the hydraulic unit comprises means for controlling the cylinder, said control means comprising a receiver, a control unit suitable for driving the cylinder to actuate the holding means upon receipt of a valve open control signal by the receiver and to deactivate said holding means in the absence of said signal;

the control unit is suitable for driving the cylinder to actuate, at least temporarily, the holding means in the absence of a valve open signal, after reception of a silence signal by the receiver; and the device comprises releasable means for anchoring the housing in the conduit, carried by the housing.

The invention also relates to a safety installation for a fluid production well comprising a fluid flow conduit, said installation comprising:

a device as defined above; and an apparatus for deploying said device in the conduit comprising a working wire line connected releasably to the connection assembly.

The invention also concerns a method of maintaining a safety device in a well comprising the following steps:

providing a device as described above in a well;

actuating the holding means upon receipt of a control signal to move the movement element in the valve housing between a rest position and an active valve (58) biasing position of the valve;

on reception of a maintenance signal, generating a first displacement of the movement element in a first direction from the active valve biasing position to an intermediate valve biasing position, in which the valve remains in its open position; and generating a subsequent second return displacement of the movement element in a second direction from the intermediate valve biasing position towards the active valve biasing position.

The method according to the invention may comprise one or more of the following features, taken in isolation or in any technically feasible combination:

the actuating means comprise a hydraulic cylinder and a hydraulic control unit for the cylinder the cylinder comprising:

a control fluid pressurising chamber, said chamber receiving a portion of the movement element of the valve; and a control fluid reserve and discharge fluid reservoir, the hydraulic control unit comprising:

a pump for feeding the control fluid into the pressurising chamber;

a pressurising conduit connecting the pressurising chamber to the discharge fluid reservoir;

a first discharge conduit fastened on the pressurising conduit provided with a discharge valve that is open in the absence of the control signal, and closed in the presence of the control signal.

a secondary discharge conduit fastened on the pressurising conduit, the secondary discharge conduit being provided with a secondary discharge valve, the method comprising, after reception of the maintenance signal, a step of opening the secondary discharge valve for a given period of time in order to generate said first displacement of the movement element, the first discharge valve remaining closed, closing again the secondary discharge valve after the given period of time;

it comprises a step of actuating the pump after closing again the secondary discharge valve and/or before opening the secondary discharge valve;

it comprises a step of monitoring a pressure threshold of the pressurizing conduit, the given time being calculated as a function of the time necessary to reach the pressure threshold after opening the secondary discharge valve, the given time being in particular a constant time after the time necessary to reach the pressure threshold, or being a multiple of the time necessary to reach the pressure threshold.

The invention will be better understood on reading the description that follows, given solely by way of an example and with reference to the accompanying drawings, in which.

Throughout the remaining text, the term "proximal" means relatively closer to the ground surface, whereas the term "distal" means relatively closer to the bottom of a well made in the ground.

The autonomous safety device 10 according to the invention, illustrated in FIGS. 1 to 8, is intended to be lowered into an oil well 12 using a wire deployment apparatus 14.

The device 10 is placed at a chosen point in the well 12, for example situated at a depth of between 10 m and 1000 m, to replace a faulty safety valve, or to add an intermediate safety valve.

Figure 1:
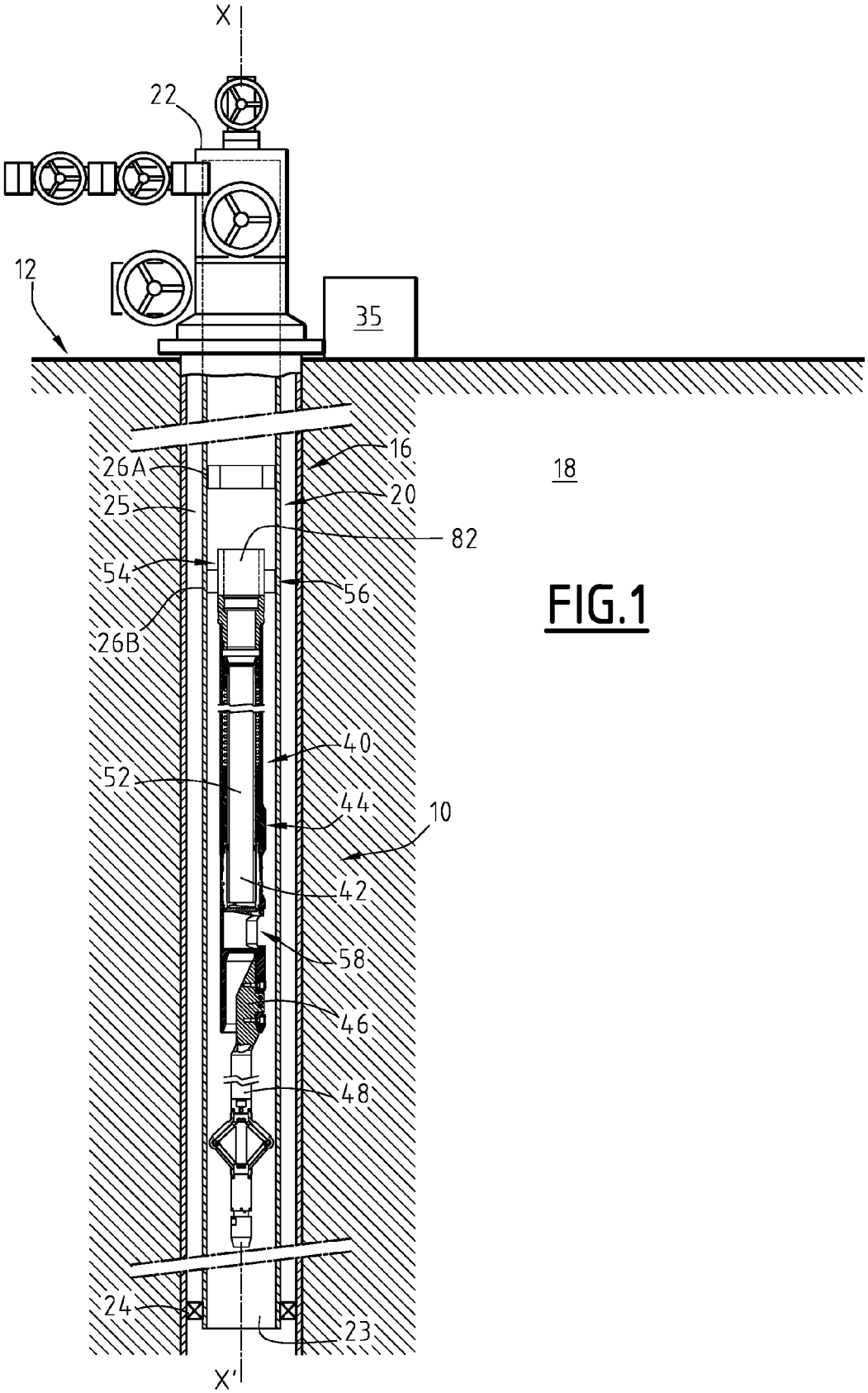
FIG. 1 is a cross-sectional view along a vertical mid-plane of an oil well equipped with a safety device according to the invention, during operation of the well.
Figure 2:
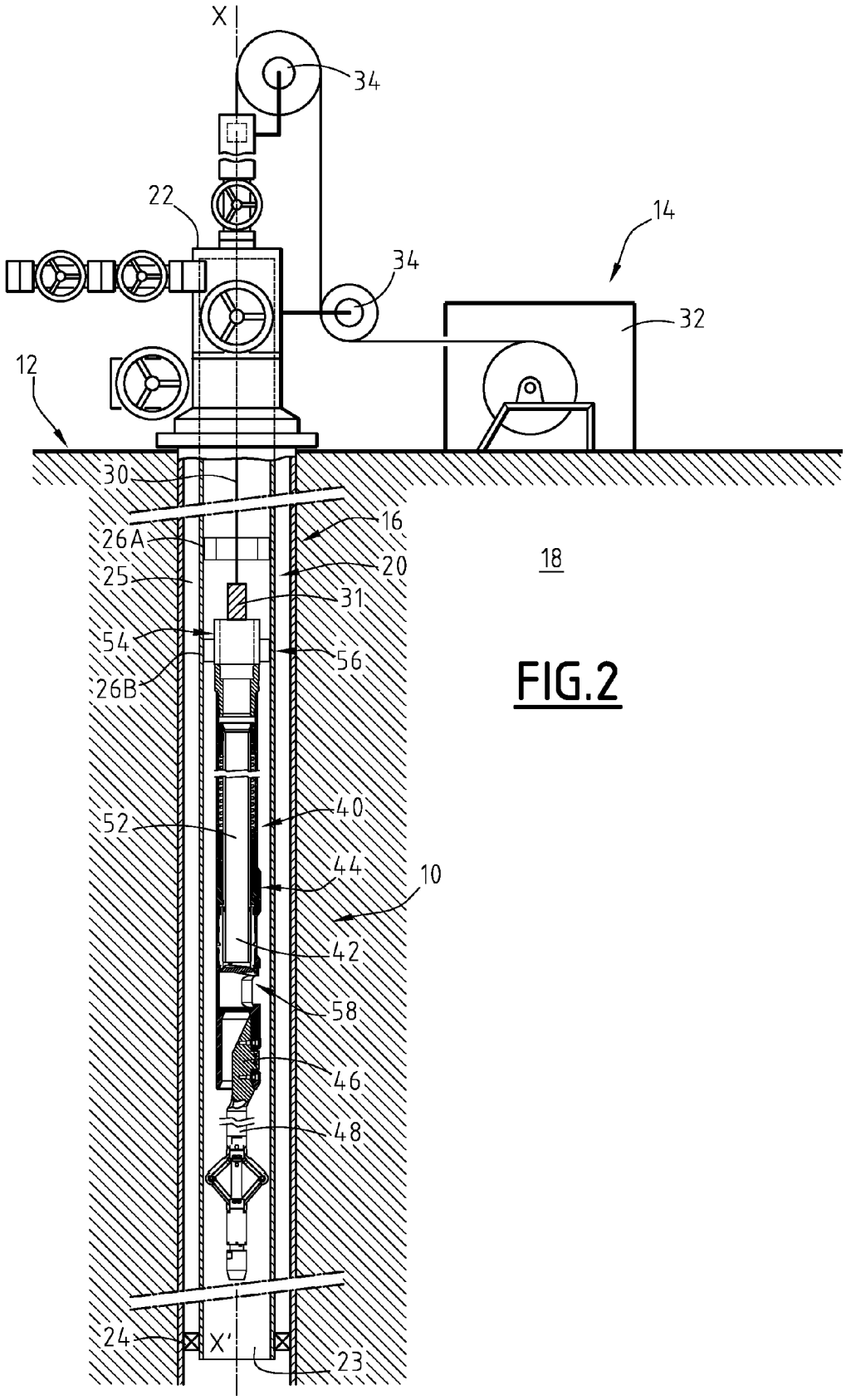
FIG. 2 is a similar view to FIG. 1, when the device is installed in the well.

As illustrated in FIGS. 1 and 2, the well 12 comprises a first conduit 16 known as the "casing" made in the sub-soil 18 and a second conduit or pipe 20 known as the "production casing" secured substantially in the centre of the first conduit 16.

The well 12 further comprises a wellhead 22 at the surface to seal selectively the first conduit 16 and the second conduit 20.

The second conduit 20 is usually not as long as the first conduit 16. It opens at a point 23 into the first conduit 16 situated in a distal portion of the well 12. Annular packing elements 24 are arranged between the first conduit 16 and the second conduit 20 in the vicinity of the point 23.

These elements 24 seal tightly the annular space 25 defined between the conduits 16 and 20.

The second conduit 20 defines internally a plurality of circular engagement grooves or annular engagement recesses 26A, 26B, designated by the term "landing nipple". Said recesses 26A, 26B are situated at points spaced longitudinally along the conduit 20.

In a variant, the second conduit 20 is not provided with recesses 26A, 26B, and the device 10 is anchored directly against a smooth wall of the conduit 20.

As illustrated in FIG. 2, for the installation of the device 10 in the well 12, the deployment means 14 of the device 10 comprise a working wire line 30, a surface winch 32 enabling the line 30 to be deployed or retracted in the well 12, and pulleys 34 for orienting the line 30 mounted on the wellhead 22.

The line 30 is formed for example by a smooth single strand wire of the "piano wire" type, commonly referred to by the term "slickline", with or without electrical insulation on its outer surface. The line 30 comprises, at its distal end, an installation gear 31 for the device 10.

In a variant, the line 30 is a mechanically reinforced electric cable, commonly referred to by the term "electric line", or a hollow spiral cable, commonly referred to by the term "coiled tubing".

The winch 32 and the pulleys 34 allow the working line 30 to be deployed successively in the second conduit 20, then in the first conduit 16 via the wellhead 22.

As illustrated in FIG. 1, when operating the well 12, the deployment means 14 have been withdrawn and the well 12 comprises means 35 for emitting a signal for controlling the safety device 10. In the example illustrated, the control signal is an electromagnetic signal and the means 35 are arranged at the surface. In a variant, said signal is an acoustic signal.

As illustrated in FIG. 2, the safety device 10 comprises a safety valve housing 40, means 42 for holding the safety valve in an open position, and a hydraulic cylinder 44 for actuating the holding means 42.

The device 10 also comprises a hydraulic unit 46 fixed removably at a distal end of the housing 40, the unit 46 comprising means 48 for controlling the cylinder 44, batteries 49 for supplying electrical power to the unit 46, and a pressurization assembly.

Figures 4, 5, 6:
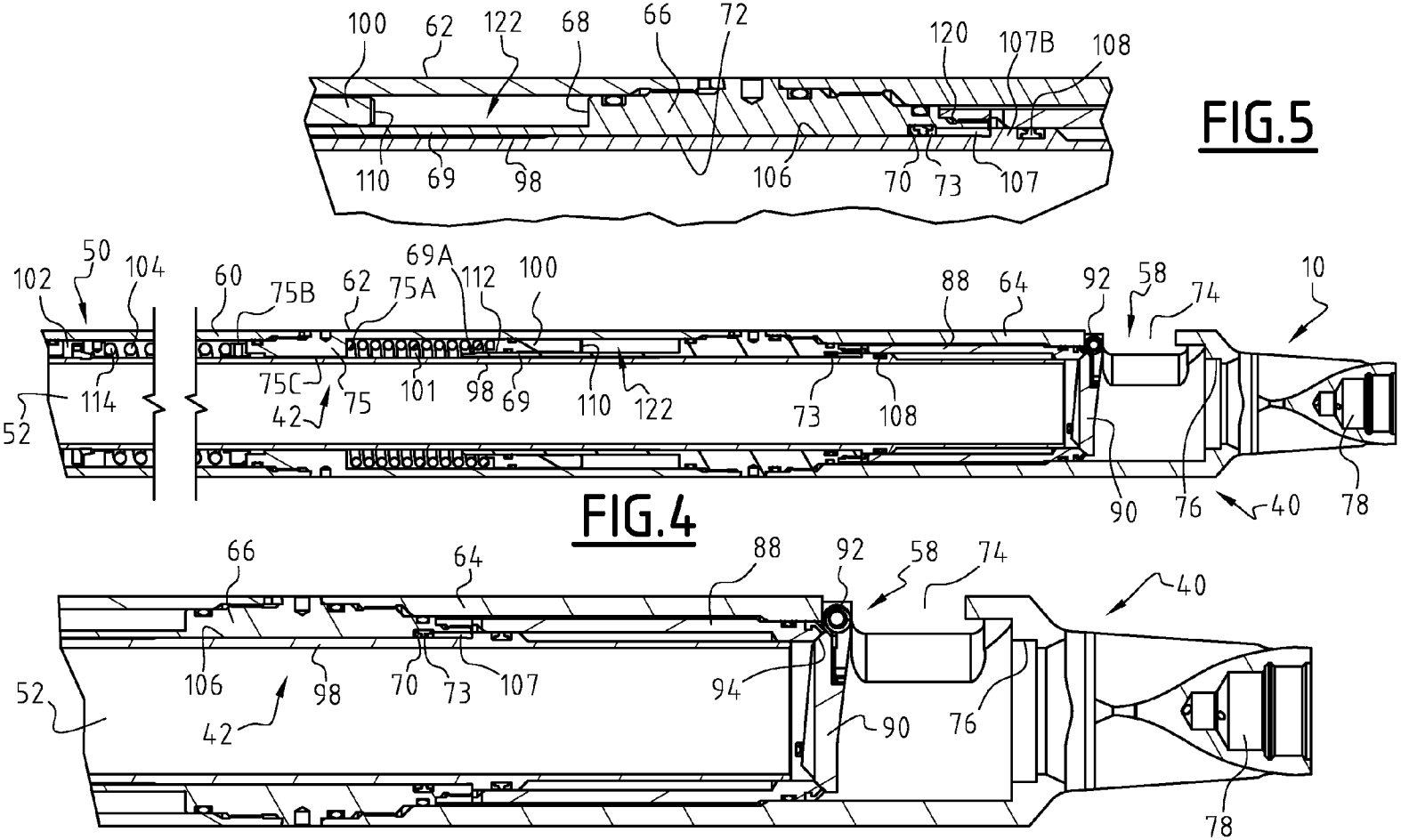
FIG. 4 is a cross-sectional view along a vertical mid-plane of a detail of the device in FIG. 3, the valve being in a closed position.
FIG. 5 is a view of a detail marked V in FIG. 4.
FIG. 6 is a detailed view of the valve of the device, in the closed position.

As illustrated in FIGS. 2 and 4, the valve housing 40 comprises a tubular body 50 with a longitudinal axis X-X' delimiting internally a longitudinal through-flow passage 52 for circulating an oil fluid, means 54 for connecting to the installation gear 31, mounted at a proximal end of the body 50, and means 56 for anchoring the device 10 in the second conduit 20.

The housing 40 further comprises, in the vicinity of its distal end, a valve 58 for sealing the passage 52.

From a proximal end, to the left in FIG. 4, to a distal end, to the right in FIG. 4, the body 50 comprises a proximal tubular portion 60, a portion 62 for guiding and holding the valve, and a distal portion 64 for connecting to the hydraulic unit 46.

As illustrated in FIG. 5, the mid-portion 62 defines a proximal sheath 66 mounted in the tubular portion 60 and delimiting an annular transverse surface 68 directed towards the tubular portion 60.

The proximal sheath 66 comprises an inner tubular wall 69 which extends proximally from the annular transverse surface 68.

The inner tubular wall 69 defines a proximal release 69A (visible in FIG. 4) which allows evacuation of the gas migrating from the bottom of the wall through the valve 58 when the valve 58 is closed.

The proximal gas release is for example a longitudinal notch made in the outer surface of the inner tubular wall 69.

The mid-portion 62 also delimits a distal annular shoulder 70 (FIG. 5) directed towards the distal portion 64 and a cylindrical guide surface 72 extending between the proximal surface 68 and the distal shoulder 70.

The cylindrical surface 72 delimits, between the distal shoulder 70 and the transverse surface 68, an annular recess which receives a proximal sealing gasket 73.

The mid-portion 62 further defines a proximal stop 75 protruding radially towards the axis X-X'.

The proximal stop 75 delimits a first surface 75A facing the annular transverse surface 68 of the proximal sheath 66 and a second opposed surface 75B facing away from the transverse surface 68.

The stop 75 is fixed in the passage 52. It further defines a proximal cylindrical guide surface 75C extending between the first surface 75A and the second surface 75B towards axis X-X'.

Figure 3:
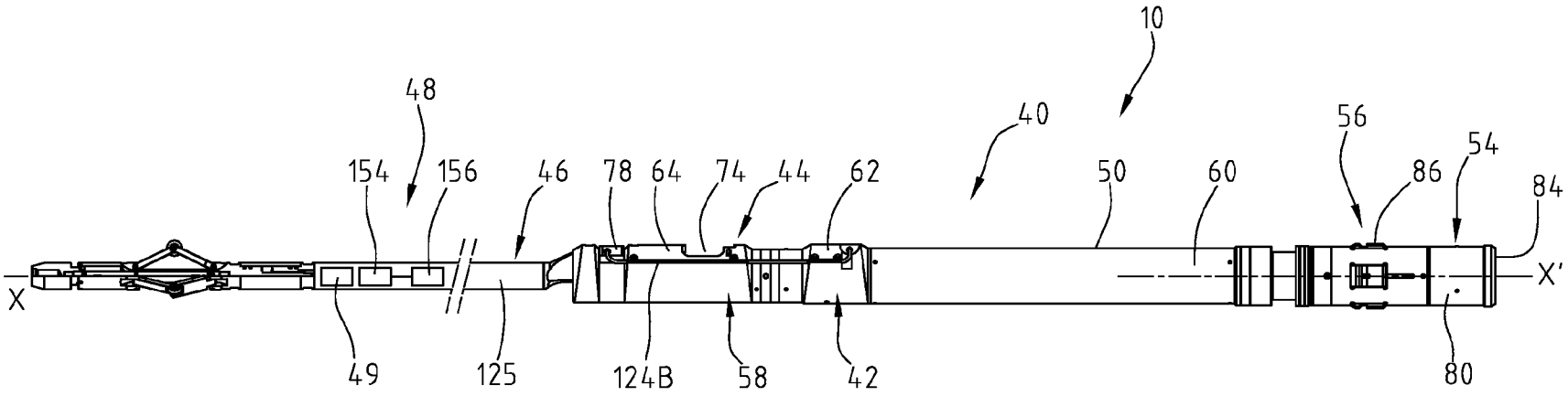
FIG. 3 is a side view of the safety device illustrated in FIG. 1 and in FIG. 2.

Distally along the axis X-X' in FIGS. 3, 4 and 6, the distal tubular portion 64 delimits a lateral valve retraction opening 74, which opens into the passage 52, an annular shoulder 76 oriented towards the distal end of the body 40, and a passage 78 for assembling the hydraulic unit.

In reference to FIG. 3, the connection means 54 comprise a head 80 for receiving the installation gear 31 delimiting an internal recess 82. The head 80 is screwed to the proximal end of the tubular portion 60.

As shown in FIG. 1 the recess 82 opens distally into the passage 52 and proximally through a proximal opening 84. A fluid may thus penetrate into the passage 52 of the housing 40 when the installation gear 31 is arranged at a distance from the housing 82.

The anchoring means 56 comprise lateral locking mandrels or "dogs" referred to by the term "lock mandrel". The dogs 86 project radially outside of the head 80 and have a form complementary to that of the engagement recesses 26A, 26B arranged in the second conduit 20.

The anchoring means 56 also comprise compressible annular packing (not illustrated) intended to form a seal between the wall of the conduit 20 and the head 80.

In reference to FIG. 6, the sealing valve 58 comprises an annular seat 88 mounted fixed by with the body 50 in the passage 52, and a flapper or shutter 90 that can move between an open position of the passage 52 (FIGS. 7 and 8) and a sealed position of the passage 52 (FIG. 6). The valve 58 also comprises a spring 92 for returning the shutter 90 to its sealed position.

The valve seat 88 is fixed in the passage 52. The valve seat 88 advantageously defines a distal conical annular surface 94 for receiving the shutter 90.

As will be seen below, the shoulder 76 has a length, taken along axis X-X' which is able to accommodate a local displacement of the means for holding the valve 42 without sealing the sealing valve 58. This shoulder has for example a length greater than 5 mm, in particular greater than 10 mm.

The shutter 90 can rotate about a horizontal axis perpendicular to the axis X-X' situated in the vicinity of the distal surface 94 of the seat 88.

Figure 7:
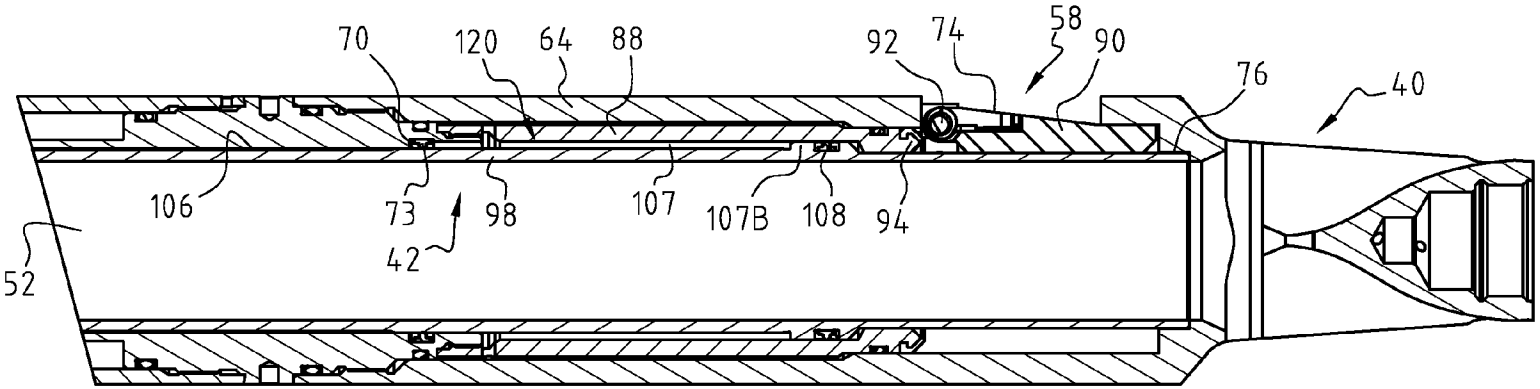
FIG. 7 is a view similar to FIG. 6 in which the valve is in its open position, the movement element for moving the valve being in its active valve biasing position.
Figure 8:
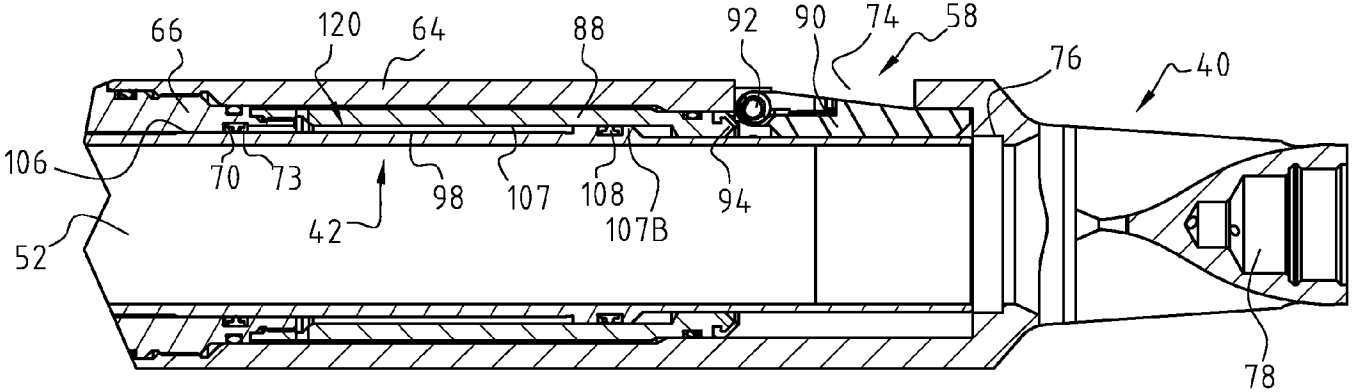
FIG. 8 is a view similar to FIG. 7, the movement element being in its intermediate valve biasing position.

In the open position of the shutter 90 illustrated in FIGS. 7 and 8, said shutter 90 extends substantially in the extension of the tubular portion 64 to seal the lateral opening 74 and free the passage 52.

In the sealed position, illustrated in FIG. 6, the shutter 90 extends in a plane that is substantially perpendicular to the longitudinal axis X-X' of the valve housing 40. It rests on the distal conical annular surface 94 to seal the passage 52.

The spring 92 permanently biases the shutter 90 towards its sealed position.

The means 42 for holding the valve in its open position comprise a cylindrical movement element or sleeve 98 mounted movably in translation along the axis X-X' in the passage 52, between a proximal rest position and a distal open position of the valve 58.

The sleeve 98 is also referred to as "flow tube".

The means 42 further comprises a proximal end stop 102 for guiding the sleeve, and a proximal spiral spring 104 for returning the sleeve to its proximal position.

The sleeve 98 extends longitudinally in the body 40 in the proximal tubular portion 60, in the mid-portion 62 and, when it is in its proximal position, in the distal portion 64.

Figure 9:
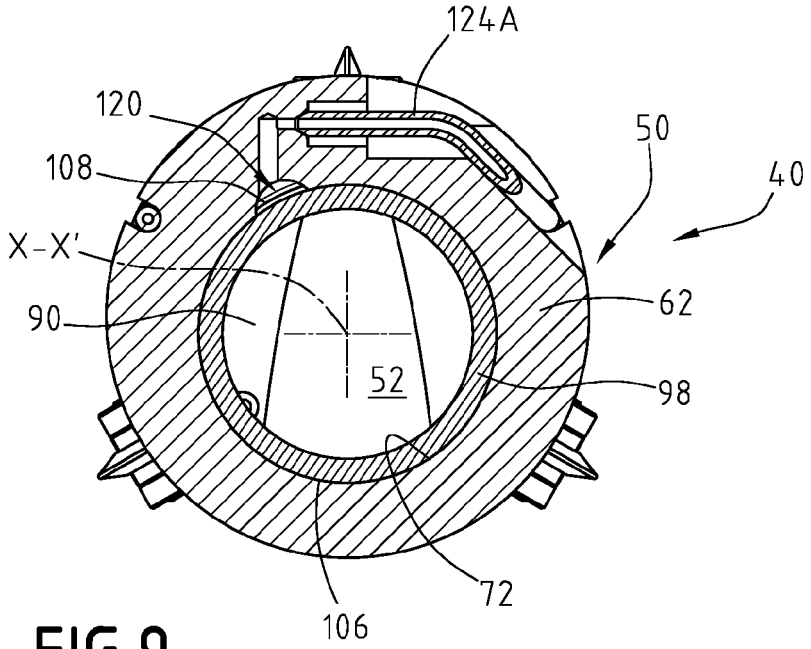
FIG. 9 is a cross sectional view along the plane VII-VII of FIG. 3.

As illustrated in FIG. 9, the sleeve 98 delimits an outer surface 106 of transverse cross-section substantially complementary to the guide surface 72 of the mid-portion 62 and to the guide surface 75C of the stop 75. Accordingly, the mid-portion 62 and the stop 75 guide the sleeve 98 in translation along axis X-X' when it moves between its proximal position and its distal position.

As illustrated in FIG. 5, the surface 106 delimits with the body 50, an annular space 107. It comprises an annular rib 107B which delimits a distal recess oriented towards the seat 88. The recess receives a sealing gasket 108 which distally seals the annular space 107. The space 107 is sealed proximally by the proximal gasket 73.

The distal spiral spring 101 is inserted between the first surface 75A of the proximal stop 75 and the annular surface 112 of the distal annular piston 100.

It biases the piston 100 towards the sealing valve, in a distal direction.

As seen on the left of FIG. 4, the proximal annular end stop 102 is fixedly mounted on the proximal end of the sleeve 98. It extends between the sleeve 98 and the tubular portion 60. The end stop 102 slides in the tubular portion 60 and delimits a distal annular surface 114 on which the proximal end of the spring 104 rests.

The proximal spiral spring 104 is inserted between the second surface 75B of the stop 75 and the distal annular surface 114 of the end stop 102.

The proximal spring 104 biases the sleeve 98 towards its proximal position.

Thanks to the use of two distinct springs 101, 104, it is possible to adjust separately the biasing force of the piston 100 towards the distal end of the housing 40 and the biasing force of the sleeve 98 towards the proximal position.

In the proximal position of the sleeve 98, illustrated in FIGS. 4 and 5, the gasket 108 extends in the vicinity of the gasket 73. In addition, the end stop 102 is situated in the vicinity of the receiving head 80. The distance separating the surface 75B and the end stop 102 is then at the maximum. The spring 104 is pre-stressed in such a way that it exerts a minimal return force on the end stop 102.

In this position, the distal edge of the sleeve 98 is arranged in the seat 88, proximally in relation to the shutter 90.

In the active valve biasing position of the sleeve 98, illustrated in FIG. 7, the distance between the surface 75B and the end stop 102 is minimal. The compression of the spring 104 is at the maximum in such a way that it exerts maximum return force on and stop 102.

In this position, a distal portion of the sleeve 98 extends opposite the lateral opening 74. The distal edge of the sleeve 98 rests at the end of shoulder 76 of the distal portion 64. The sleeve 98 fully covers the shutter 90. In addition, the gasket 108 is at a maximal distance distally from the gasket 73.

According to the invention, the sleeve 98 is able to be placed in an intermediate valve biasing position shown in FIG. 8, between the active valve biasing position and the rest position.

In the intermediate valve biasing position, the distal edge of the sleeve 98 is located apart from the end of the shoulder 76. However, it remains in the vicinity of the distal edge of the shutter 90, the shutter 90 being held in its open position.

As a consequence, the shutter 90 remains in its open position and does not move when the sleeve moves between the active valve biasing position and the intermediate valve biasing position. In addition, the shutter 90 is still protected from the well flow by the sleeve 98.

The pressurizing assembly comprises a distal pressurization piston 100, and a distal spiral spring 101 for biasing the piston 100.

The distal annular piston 100 is mounted slidingly on the outer surface of the inner wall 69, radially between the outer surface 106 and the portion 62. It is received axially in a intermediate space defined by the first surface 75A and by the proximal surface 68. As shown in FIG. 5, it delimits a distal annular surface 110 which extends opposite the proximal surface 68. It further delimits a proximal annular surface 112 (shown in FIG. 4) on which a distal end of the spring 101 rests.

Figure 10:
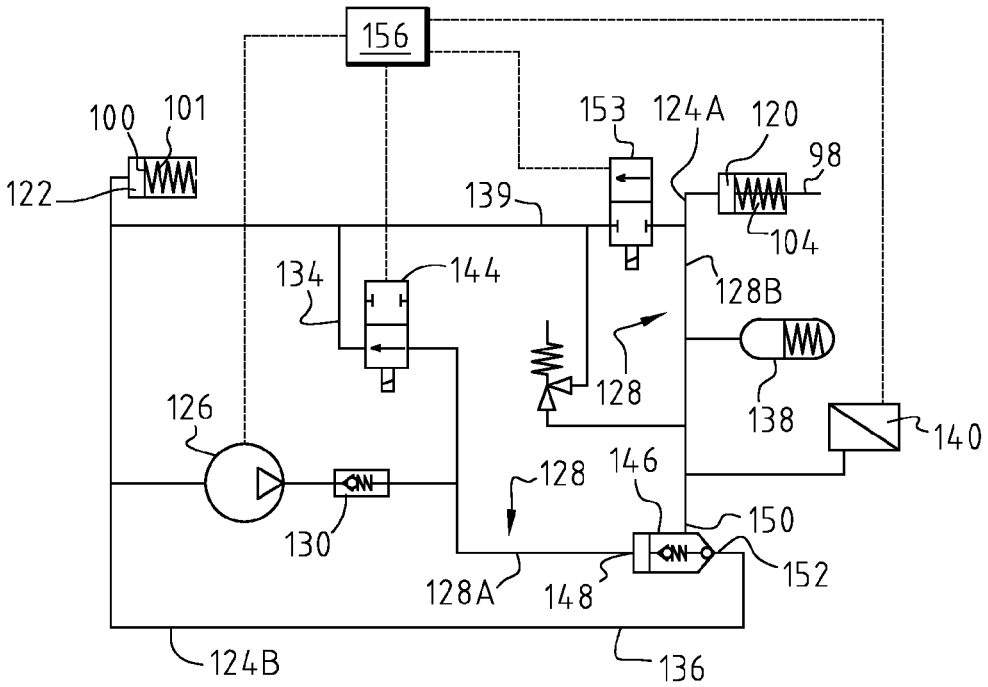
FIG. 10 is a diagrammatic view of the hydraulic actuating means of the device in FIG. 3.

As illustrated in FIG. 10, the hydraulic cylinder 44 comprises a pressurising chamber 120 and a reserve and fluid reservoir 122 which are connected hydraulically to the unit 46 by respective connection conduits 124A, 124B. The fluid reservoir 122 and the chamber 120 contain a hydraulic fluid for controlling the cylinder 44.

The chamber 120 comprises at least the annular space 107 of variable volume. In the proximal position of the sleeve 98, the distance between the proximal gasket 73 and the distal gasket 108 is minimal and the volume of the chamber 120 is minimal. In the distal position of the sleeve 98, this distance is at the maximum and the volume of the chamber 120 is at the maximum.

In reference with FIG. 5, the fluid reservoir 122 extends between the body 50 and the sleeve 98 proximally in relation to the chamber 120. It is delimited by the proximal tubular portion 60, by the proximal surface 68 of the mid-portion 62, by the inner wall 69, by the surface 106, and by the distal surface 110 of the piston 100.

The volume of the fluid reservoir 122 depends on the longitudinal position of the piston 100 along the inner wall 69 and along the body 50.

When the piston 100 is located facing the inner wall 69, distally from the release 69A, the fluid reservoir 122 is sealingly closed by the piston 100.

When the piston 100, is located opposite the release, escape of oil and gas from the fluid reservoir 122 towards the proximal part of the device 10 is possible.

The conduits 124A, 124B advantageously extend outside the body 50 along said body. They open out distally in the region of the lateral passage 78 for assembling the unit 46. In addition, the distal connection conduit 124A opens proximally in the intermediate space 121 of the chamber 120 via the mid-portion 62.

The proximal connection conduit 124B opens proximally in the fluid reservoir 122 through the mid-portion 62.

As illustrated in FIGS. 3 and 10, the unit 46 comprises a tubular housing 125 receiving a hydraulic electric pump 126 and a conduit 128 for selectively pressurising the chamber 120, connecting the electric pump 126 to the distal connection conduit 124A.

In this example, the tubular housing 125 projects distally outside the body 50 along the axis X-X'. The proximal end thereof is introduced into the distal opening of the distal portion 64 and received in the assembly passage 78 in order to be fixed to the distal portion 64 of the body 50.

The electric pump 126 connects the proximal connection conduit 124B to an inlet of the conduit 128 so as to connect the fluid reservoir 122 to the conduit 128.

The pressurising conduit 128 comprises, from upstream to downstream, from the electric pump 126 to the chamber 120, a zero-leak non-return valve 130 and an upstream portion 128A on which is fastened a first discharge conduit 134. The conduit 128 also comprises a downstream portion 128B on which are connected a rapid discharge conduit 136, an accumulator 138, a second discharge conduit 139, and a pressure switch 140.

The first discharge conduit 134 is fastened on the upstream portion 128A of the conduit 128, upstream of the second discharge conduit 139. The conduit 134 is provided with a controlled safety solenoid valve 144, which is normally open, and which opens into the proximal connection conduit 124B.

The solenoid valve 144 is connected electrically to the control means 48.

The first rapid discharge conduit 136 is connected on the pressurising conduit 128 by means of a bypass valve 146, delimiting the upstream portion 128A and the downstream portion 128B on the conduit 128.

The valve 146 comprises a primary inlet 148 and a primary outlet 150 opening respectively into the upstream portion 128A of the pressurising conduit 128 towards the electric pump 126, and into the downstream portion 128B of the conduit 128 towards the chamber 120. The valve 146 also comprises a secondary outlet 152 connected to the rapid discharge conduit 136.

When the pressure that prevails in the region of the primary inlet 148 is greater than or substantially equal to the pressure that prevails in the region of the primary outlet 150, the secondary outlet 152 is sealed in such a way that the primary inlet 148 is connected hydraulically to the primary outlet 150.

On the other hand, when the pressure that prevails in the region of the primary inlet 148 is less than the pressure that prevails in the region of the primary outlet 150, the primary inlet 148 is sealed and the primary outlet 150 is connected hydraulically to the secondary outlet 152 and thus to the fluid reservoir 122 by means of the conduit 124B.

The minimum flow cross-section through the downstream portion 128B, the secondary outlet 152 and through the rapid discharge conduit 136 is much greater than the maximum flow cross-section through the upstream portion 128A, the solenoid valve 144 and through the first discharge conduit 134, for example at least twice as great.

The second discharge conduit 139 is connected on the downstream portion 128B of the pressurizing conduit 128, advantageously downstream of the accumulator 138. It is connected hydraulically to the fluid reservoir 122.

In the example of FIG. 8, it merges with the first conduit 134 upstream of the pump 126.

The second conduit 139 is provided with a controlled maintenance solenoid valve 153, which is normally closed, and which opens in the proximal connection conduit 124B.

The pressure switch 140 is connected on the pressurizing conduit 128, downstream of the by pass valve 146.

As illustrated in FIG. 3, the control means 48 are received in the tubular housing 125. They comprise a receiver 154 and a unit 156 for controlling the cylinder 44.

The receiver 154 is able to receive a valve open control signal emitted from the surface and to transmit an order to the control unit 156 to hold the shutter 90 in its open position, for as long as the control signal is received by the receiver 154.

The receiver 154 is also able to receive a temporary silence signal for the well 12 and to transmit an order to the control unit 156, to hold the shutter 90 temporarily in its open position even in the absence of a valve open signal.

According to the invention, the receiver 154 is further able to receive a maintenance signal for the device 10 and to transmit an order to the control unit 156 to produce a short first displacement of the sleeve 98, from the active biasing position of the valve 58, shown in FIG. 7, to an intermediate valve biasing position, shown in FIG. 8, in which the valve 58 remains in its open position, and a subsequent second return displacement of the sleeve 98 from the intermediate valve biasing position towards the active valve biasing position.

The control unit 156 is connected electrically to the solenoid valves 144 and 153, to the pump 126, and to the pressure switch 140 for controlling the cylinder 44.

The operation of the autonomous safety device 10 according to the invention, for example to replace a defective valve in the well 12, will now be described.

Initially, a valve housing 40 is selected of suitable dimensions for insertion into the second conduit 20.

A hydraulic unit 46 common to valve housings 40 of different diameters is fixed in the lateral passage 78 and is connected hydraulically to the distal ends of the conduits 124A and 124B.

The autonomous device 10 according to the invention is thus formed.

Then, with reference to FIG. 2, the deployment means 14 are arranged on the wellhead 22. The installation gear 31 is mounted on the receiving head 80 at the proximal end of the valve housing 40.

The valve housing 40, the holding means 42, the hydraulic actuating cylinder 44 and the hydraulic unit 46 connected to the housing 40, forming the device 10, are then introduced into the second conduit 20 and are thus lowered simultaneously under the control of the working wire line 30.

When the device 10 reaches the desired position in the second conduit 20, for example when the anchoring means 56 are arranged opposite an engagement recess 26B, the working wire line 30 is halted.

The anchoring means 56 are then actuated by the operator to lock the housing 40 in position in the conduit 20.

Accordingly, the engagement dogs 86 are inserted in the recesses 26B and a sealed connection is formed between the housing 40 and the second conduit 20.

Then, the installation gear 31 is released from the connection means 54, to free the opening 84 at the inlet of the passage 52. The deployment means 14 are then withdrawn (FIG. 1).

The shutter 90 is maintained in the position in which it seals the passage 52, the sleeve 98 being in its proximal position, as depicted in FIGS. 4 to 6.

The safety device 10 then tightly seals the second conduit 20.

When the well operator wishes to open the second conduit 20, he actuates the emission means 35 at the surface to emit a valve open control signal.

When the receiver 154 receives the valve open control signal, it transmits an actuation order to the control unit 156. The unit 156 then actuates the electric pump 126 and the solenoid valves 144 and 153 to introduce a portion of the liquid contained in the fluid reservoir 122 into the chamber 120. The volume of the fluid reservoir 122 reduces, which causes the distal movement of the piston 100.

In this regard, the priming of the electric pump 126 is assisted by the presence of the proximal spring 101 which rests on the piston 100 when the sleeve 98 is in its proximal position, to compress slightly the fluid contained in the fluid reservoir 122.

Once the electric pump 126 is primed and the solenoid valve 144 and 153 are closed, the pressure in the chamber 120 increases and is applied in the annular space 107, between the proximal gasket 73 and the distal gasket 108, which causes the sleeve 98 to move towards its distal position, against the return spring 104 which is compressed between the piston 100 and the end stop 102.

During this movement, the distal edge of the sleeve 98 pushes the shutter 90, and moves it from the sealed position to its open position, against the biasing spring 92.

When the sleeve 98 has reached its active biasing position shown in FIG. 7, it comes to a stop against the end-stop shoulder 76. The shutter 90 is secured against the distal portion 64 and seals the lateral opening 74.

Moreover, the pressure in the chamber 120 increases to a threshold value which is detected by the pressure switch 140 and transmitted to the unit 156. When the control unit 156 determines that the pressure in the chamber 120 is greater than the threshold value, it disconnects the electric pump 126.

The solenoid valve 144 is kept sealed for as long as the receiver 154 receives a valve open control signal.

If the pressure in the chamber 120 falls below a re-start value for the electric pump 126, the control unit 156 actuates the electric pump 126 once again to raise the pressure in the chamber 120 to the threshold value.

However, the presence of a zero-leak non-return valve 130 as well as zeroleak valves 153 and 144 reduces the operating time of the electric pump 126 and increases the autonomy of the device 10.

The accumulator 138 allows pressure variations in the chamber 120, due in particular to temperature variations in the housing 40, to be compensated.

According to the invention, at regular intervals, a maintenance cycle is carried out.

Figure 11:
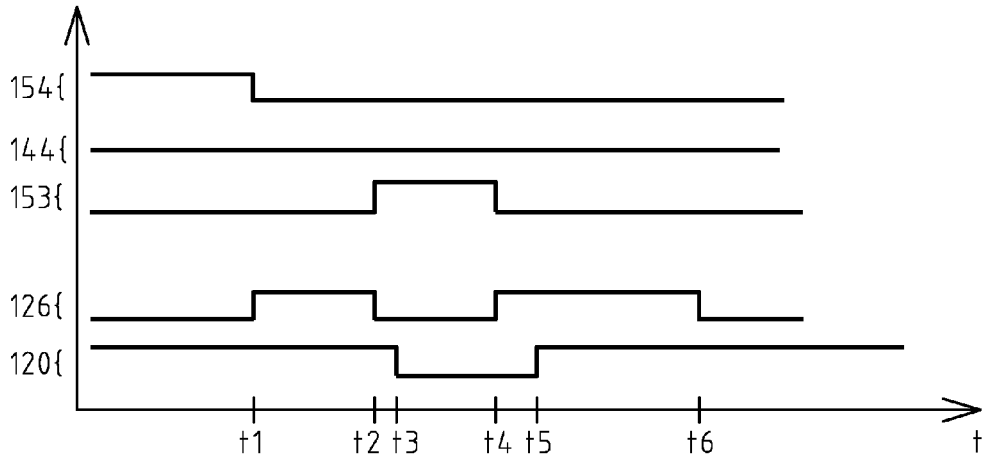
FIG. 11 is a graph illustrating a sequence of operation of the safety device in a first method of maintaining the device.

In a first embodiment depicted in FIG. 11, before time t1, no maintenance signal is received. At time t1, a maintenance signal is received by the receiver 154 and is transmitted to the control unit 156.

In the embodiment of FIG. 11, the control unit 154 then activates the pump 126 for a given activation time t2-t1 to pre-increase the pressure into the pressurizing conduit, the accumulator 138, and the chamber 120.

During this pre-activation step, the solenoid valves 144, 153 remain closed.

At instant t2, the maintenance valve 153 is opened while the solenoid valve 144 remains closed. In a variation, the valve 153 could be opened after t2 at an instant t2 tx Since no pressure variation occurs at the primary inlet 148, the secondary inlet 152 remains closed.

A small quantity of fluid then evacuates from the chamber 120 through the maintenance valve 153 and the secondary discharge conduit 139 towards the fluid reservoir 122.

This evacuation produces a first displacement of the sleeve 98 from the active valve biasing position towards the intermediate valve biasing position.

The pressure slowly decreases into the downstream portion 128B of the pressurizing conduit 128. At instant t3, the pressure reaches a threshold which is detected by the pressure switch 140.

In the first embodiment, the maintenance solenoid valve 153 remains opened for a given constant period of time which is for example in the order of five to ten seconds. At instant t4, the sleeve 98 has reached its intermediate valve biasing position axially apart from the active valve biasing position. The control unit 156 closes the maintenance valve 153 and reactivates the pump 126.

The pressure gradually increases into the downstream portion 128B of the pressurizing conduit 128 and in the chamber 120. This produces a second return displacement of the sleeve 98 from the intermediate valve biasing position towards the active valve biasing position until the sleeve 98 stops against the end of the stop shoulder 76.

The length of the stop shoulder 76 is configured to accommodate the first and second displacement of the sleeve 98. It has for example a length greater than 2 mm, in particular greater than 5 mm and comprised between 5 mm and 15 mm.

At instant t5, the pressure has increased sufficiently to be above the pressure threshold detected by the pressure switch 140. At time t6, the pump 126 is deactivated.

Thanks to the strength of the return spring 104, which is independent from the compensation spring 101 ensuring a pressure compensation in the fluid reservoir 122, the sticking of the gasket 108 of the sleeve 98 is prevented.

Moreover, the small displacement of the sleeve 98 avoids the blocking of the gasket 108, when it is done regularly.

The movement of the sleeve 98 is generated without having to close the valve 58. On the contrary, the shutter 90 remains still and open. Production of fluid in the well is not stopped during the maintenance operation.

Figure 12:
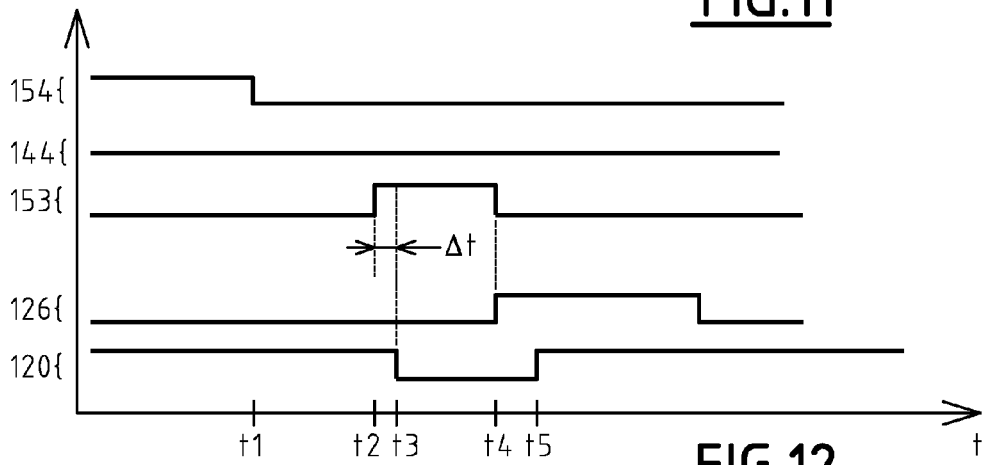
FIG. 12 is a graph similar to FIG. 11, in a second method of maintaining the device.

In a variant, shown in FIG. 12, the given time for opening the maintenance valve 153 is calculated based on the time Δt necessary for the pressure to reach the pressure threshold detected by the pressure switch 140. This time is representative of the viscosity of the fluid.

In the example of FIG. 12, the given time is the sum of the time Δt necessary to reach the pressure threshold and a constant time θ.

Figure 13:
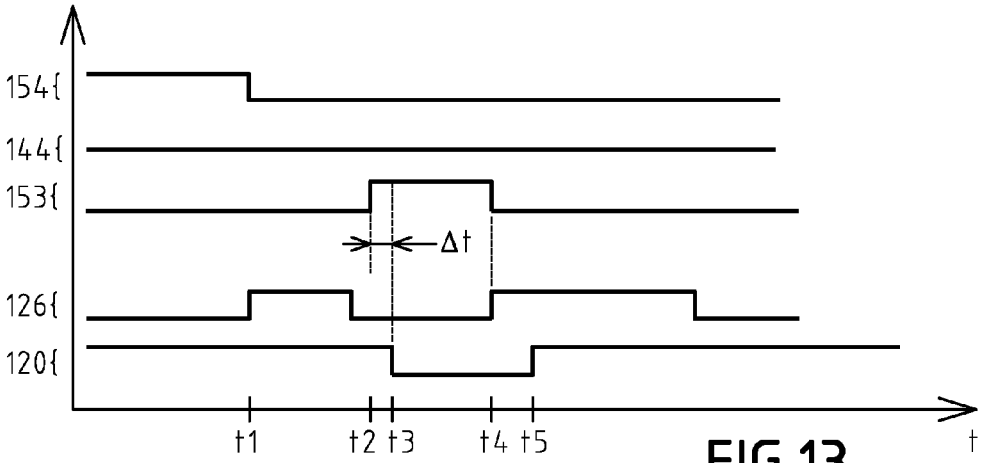
FIG. 13 is a graph similar to FIG. 11 in a third method of maintaining the device according to the invention.

In the example of FIG. 13, the time is a multiple of the time Δt necessary to reach the pressure threshold.

The length of displacement of the sleeve 98 is therefore controlled accurately to provide a significant back and forth movement of the sleeve 98, without risk of closing the valve 58.

In the event of an incident at the surface, the valve open control signal emitted by the emission means 35 is disconnected.

Once the receiver 154 no longer receives said signal, the control unit 156 determines whether a temporary silence signal has been emitted before disconnecting the valve open control signal. In the absence of such a silence signal, the control unit 156 deactivates the solenoid valve 144 and then resumes its normally open position.

With reference to FIG. 10, the fluid contained in the upstream portion 128A of the conduit 128, upstream of the primary inlet 148 of the rapid discharge valve 146 is then reintroduced into the fluid reservoir 122 via the first discharge conduit 134 and the proximal connection conduit 124B.

The pressure that prevails in the region of the primary inlet 148 thus reduces to a value below that which prevails at the primary outlet 150.

As a follow-up, the secondary outlet 152 of the rapid discharge valve 146 opens, and the primary inlet 148 closes. The fluid contained in the pressurising chamber 120 is therefore discharged very rapidly into the fluid reservoir 122 via the downstream portion 128B of the conduit 128, the primary outlet 150, the secondary outlet 152, the rapid discharge conduit 136 and the proximal connection conduit 124B.

As the pressure in the chamber 120 falls rapidly, the return spring 104 moves the sleeve 98 towards its proximal position very rapidly. Since the volume of the fluid reservoir 122 increases after the rapid discharge valve 146 opens, the difference in length of the spring 101 resting proximally on the piston 100 between the proximal position and the distal position of the sleeve 98 is less than the travel of the sleeve 98 between said positions.

The biasing spring 92 then returns the shutter 90 to its sealed position across the passage 52, as illustrated in FIG. 3. The well 12 is thus made safe.

However, if the operator has issued a previously programmed silence signal, before the disconnection of the valve open signal, the control unit 156 maintains the solenoid valve 144 sealed and the chamber 120 under pressure for a determined period of time, despite the absence of a control signal. The shutter 90 therefore remains in the open position.

This operating method maintains production of the well 12, even if an intervention requiring the absence of any control signal must be carried out on another nearby well.

If a control signal is once more emitted, the control unit 156 is reinitialised, such that the disconnection of the control signal causes the shutter 90 to close once more.

Thanks to the invention that has just been described, it is possible to have an autonomous safety device 10 that is easily installed and anchored in a well 12 by a working wire line 30. Said device comprises a valve housing 40, means 42 for holding the valve in an open position, and hydraulic actuating means 44, 46 holding means 42, connected to the housing 40, for the simultaneous movement thereof in the well 12.

Such a device 10 can be used at any point in the well 12, without the need to introduce hydraulic or electric control lines, either to replace an existing defective valve in the well 12, or to install a new valve in the well 12 without having to raise the production casing.

The arrangement of the hydraulic unit 46 in the valve housing frees the fluid flow passage 52 inside the valve housing and opens a passage 52 of sufficient diameter for the production of hydrocarbons or the passage of tools as far as the shutter 90.

The structure of the hydraulic unit 46 is suitable for connection thereof to valve housings 40 of different diameters. In addition, the structure thereof consumes little energy, for autonomous operation of the device 10 over a long period of between six months and two years without the need to raise the device 10 to the surface.

Moreover, the device can be maintained at regular intervals, which increases its reliability and operative time.

Additionally, the reliability of the safety device 10 is increased through the provision of a release 69A in the compensation fluid reservoir 122. When migration of gas occurs through the valve 58 through the gasket 108, 73, it prevents the fluid reservoir 122 from being filled with pressurized gas, which could lead to locking the valve 58 in the open position when it is reopened.

In a variant, the secondary discharge conduit 139 does not comprise a secondary solenoid valve 153.

The secondary solenoid valve is replaced with a restriction which is permanently open. The restriction allows a small permanent leak of fluid from the chamber 120 to the fluid reservoir 122 through the secondary discharge conduit 139.

The pressure hence gradually decreases in the chamber 120, which generates the first displacement of the sleeve 98 between the active biasing position and the intermediate biasing position.

When the pressure detected by the pressure switch decreases below a given pressure threshold the pump 128 is actuated, which generates the second return displacement.

A permanent back and forth displacement of the sleeve 98 hence occurs, which limits the risk of degradation and blocking of the sealing gaskets.

The invention claimed is:

1. A safety device for a fluid production well, comprising:

a valve housing intended to be fixed tightly inside a fluid flow conduit, the housing delimiting a fluid flow passage and comprising:

a valve used to seal the passage, and which can move between an open position of the passage and a closed position of the passage;

a biasing spring for permanently biasing the valve towards the closed position thereof; and connecting means capable of connecting the housing to a coupling member of a working wire line;

holding means for holding the valve in its open position against the biasing spring, said holding means comprising at least one movement element for the valve, which can move in the valve housing between a rest position and an active valve biasing position, and an element for returning the movement element to its rest position, the device being configured so that the valve is in the open position when the movement element is in the active valve biasing position and the valve is in the closed position when the movement element is in the rest position; and actuating means which can be controlled by a control signal to actuate the movement element upon receipt of a valve open control signal by the actuating means, wherein the valve open control signal generates a displacement of the movement element in the active valve biasing position, and to deactivate the movement element in the absence of said control signal, wherein the holding means are configured so that, upon deactivation, the movement element returns to the rest position;

wherein the actuating means are configured to actuate the movement element, on reception of a maintenance signal, to generate:

a first displacement of the movement element from the active valve biasing position to an intermediate valve biasing position, in which the valve remains in its open position; and a subsequent second return displacement of the movement element from the intermediate valve biasing position to the active valve biasing position.

2. The device according to claim 1, wherein the actuating means comprise a hydraulic cylinder and a hydraulic control unit for the cylinder, the cylinder comprising:

a control fluid pressurising chamber, said chamber receiving a portion of the movement element of the valve; and a control fluid reserve and discharge fluid reservoir, and wherein the hydraulic control unit comprises:

a pump for feeding the control fluid into the pressurising chamber;

a pressurising conduit connecting the pressurising chamber to the discharge fluid reservoir; and a first discharge conduit fastened on the pressurising conduit provided with a main discharge valve that is open in the absence of the control signal, and closed in the presence of the control signal.

3. The device according to claim 2, wherein the hydraulic control unit comprises a secondary discharge conduit, fastened on the pressurising conduit, the secondary discharge conduit being provided with a secondary discharge valve that is configured to open for a given period of time, after reception of the maintenance signal, in order to generate said first displacement, the secondary discharge valve being configured to close again after the given period of time.

4. The device according to claim 3, wherein the secondary discharge conduit is provided with a restriction orifice placed in series with the secondary discharge valve.

5. The device according to claim 3, wherein the secondary discharge conduit opens in the pressurizing conduit between the pressurizing chamber and the first discharge conduit.

6. The device according to claim 2, wherein the actuating means comprise a rapid discharge conduit, fastened on the pressurising conduit, the rapid discharge conduit being provided with a sealing element that can be released when the main discharge valve is open.

7. The device according to claim 6, wherein the maximum cross-section of the first discharge conduit and of the upstream portion of the pressurising conduit situated upstream of the releasable sealing element is less than the minimum cross-section of the rapid discharge conduit and of the downstream portion of the pressurising conduit situated downstream of the releasable sealing element.

8. The device according to claim 2 wherein the actuating means comprise a pressurisation piston disposed in the control fluid reserve and discharge fluid reservoir and a biasing element of the pressurisation piston, distinct from the element for permanently returning the movement element to its rest position.

9. The device according to claim 8, further comprising a guiding element for guiding the movement element, the biasing element being inserted between a surface of the guiding element and the pressurisation piston, the element for permanently returning the movement element to its rest position being inserted between an opposite surface of the guiding element and the movement element.

10. The device according to claim 9, wherein the guiding element is fixed relative to the housing.

11. A safety installation for a fluid production well comprising a fluid flow conduit, said installation comprising:

a device according to claim 1, and deploying means for deploying said device in the conduit, comprising the working wire line connected to the connection means.

12. A method of maintaining a safety device in a well comprising:

providing a device according to claim 1 in a well;

actuating the holding means upon receipt of the valve open control signal to move the movement element in the valve housing between the rest position and the active valve biasing position;

on reception of the maintenance signal, generating the first displacement of the movement element in a first direction from the active valve biasing position to the intermediate valve biasing position, in which the valve remains in its open position; and generating a subsequent second return displacement of the movement element in a second direction from the intermediate valve biasing position towards the active valve biasing position.

13. The method according to claim 12, wherein the actuating means comprise a hydraulic cylinder and a hydraulic control unit for the cylinder, the cylinder comprising:

a control fluid pressurising chamber, said chamber receiving a portion of the movement element of the valve; and a control fluid reserve and discharge fluid reservoir, the hydraulic control unit comprising:

a pump for feeding the control fluid into the pressurising chamber;

a pressurising conduit connecting the pressurising chamber to the discharge fluid reservoir; and a first discharge conduit fastened on the pressurising conduit provided with a main discharge valve that is open in the absence of the control signal, and closed in the presence of the control signal;

a secondary discharge conduit, fastened on the pressurising conduit, the secondary discharge conduit being provided with a secondary discharge valve;

the method comprising, after reception of the maintenance signal, opening the secondary discharge valve for a given period of time in order to generate said first displacement of the movement element, the first discharge valve remaining closed, closing the secondary discharge valve after the given period of time.

14. The method according to claim 13 further comprising actuating the pump after closing the secondary discharge valve or before opening the secondary discharge valve.

15. The method according to claim 13 further comprising monitoring a pressure threshold of the pressurizing conduit, the given time being calculated as a function of the time necessary to reach the pressure threshold after opening the secondary discharge valve.

16. The method according to claim 15, wherein the given time is a constant time after the time necessary to reach the pressure threshold.

17. The method according to claim 15, wherein the given time is a multiple of the time necessary to reach the pressure threshold.

* * * * *